US007252045B2

(12) United States Patent
Massetti et al.

(10) Patent No.: US 7,252,045 B2
(45) Date of Patent: Aug. 7, 2007

(54) STORAGE DEVICE FOR ITEMS SUCH AS MARINE LINES

(76) Inventors: Joseph A. Massetti, 5205 Pointe Tremble Rd., Algonac, MI (US) 48001-4365; Lawrence G. Smith, 102 Pearl St., Marine City, MI (US) 48039-3465

( * ) Notice: Subject to any disclaimer, the term of this patent is extended or adjusted under 35 U.S.C. 154(b) by 0 days.

(21) Appl. No.: 11/171,665

(22) Filed: Jun. 30, 2005

(65) Prior Publication Data

US 2006/0000402 A1 Jan. 5, 2006

Related U.S. Application Data

(63) Continuation-in-part of application No. 10/882,593, filed on Jul. 1, 2004.

(51) Int. Cl.
*B63B 21/00* (2006.01)

(52) U.S. Cl. ..... 114/230.2

(58) Field of Classification Search ..... 114/230.2, 114/230.23, 254

See application file for complete search history.

(56) References Cited

U.S. PATENT DOCUMENTS 1,811,400 A * 6/1931 McClellan ..... 114/218
2,625,342 A * 1/1953 Moran ..... 242/407.1
3,143,993 A 8/1964 Salerno
3,977,448 A 8/1976 Botting
4,688,674 A 8/1987 Stirtz
4,724,791 A 2/1988 McSorley
4,756,455 A 7/1988 Kitner et al.
4,846,090 A * 7/1989 Palmquist ..... 114/230.23
4,864,956 A * 9/1989 Onstwedder, Jr. ..... 114/230.24
4,875,427 A 10/1989 Harris, Jr.
5,365,872 A * 11/1994 Obrinski ..... 114/230.24
D389,727 S 1/1998 Austin et al.
5,819,679 A * 10/1998 Bonate et al. ..... 114/230.23
5,970,652 A 10/1999 Hohmann
5,971,243 A 10/1999 Peterson
6,055,923 A 5/2000 Militzer

* cited by examiner

*Primary Examiner*—Stephen Avila
(74) *Attorney, Agent, or Firm*—Young Basile P.C.

(57) ABSTRACT

A mooring line storage device and system for watercraft having a housing defining an inner cavity. The housing has at least one access aperture and a cover in overlying relationship with the aperture. Cover and housing cooperatively interact to prevent extension of a discrete region of a mooring line from the inner cavity. The device may also include at least one hanger to suspend the housing from a structural member of the watercraft.

16 Claims, 5 Drawing Sheets

STORAGE DEVICE FOR ITEMS SUCH AS MARINE LINES

The present application is a Continuation-in-Part of U.S. Ser. No. 10/882,593 filed Jul. 1, 2004 and currently pending.

The present invention relates to marine lines used for sailing watercraft and mooring watercraft to dock facilities, and more particularly to a marine line receptacle apparatus for storing the marine line in a ready to use configuration when the line is not in use. The invention also pertains to storage devices suitable for use in other recreational and transportation structures.

Watercraft, such as motor and sail boats, utilize fore and aft mooring lines at each of the port and starboard sides thereof to secure the watercraft to a dock facility. In this regard, the dock facility generally has a number of cleats or other structures, such as pilings, to which mooring lines of the watercraft may be connected. Depending on the vessel configuration, there can be places for separate fore and aft mooring lines on the port and starboard sides of the vessel to facilitate various different mooring situations a boater may encounter.

Typically, a watercraft will have a mooring line for connection with cleats on the watercraft in anticipation of future and present docking needs. Cleats are usually provided fore and aft at each of the starboard and port sides of the watercraft, whereupon four mooring lines would be needed to be connected to these four cleats.

Problematically, when a skipper leaves dock, the mooring lines may be loosely placed on the boat deck and are subject to sliding off and dangling into the water. Dangling mooring lines are, of course, unsightly and they can add drag in the water if they slip overboard. Dangling mooring lines can pose other problems to the operation of the watercraft. Dangling mooring lines that do not get drawn overboard can become fouled and pose tripping hazards to vessel occupants as they move about the vessel. If the mooring lines are secured to some component of the boat deck as to other cleats or the like to prevent potential dangling, when the mooring lines need to be made ready for docking, considerable time and effort must be expended to free them. To prevent dangling and/or fouling when the lines are attached to improper cleats, stanchions, and the like, many boaters remove the mooring lines from the cleats and store them below deck when the vessel is underway. This necessitates locating the line or lines and resecuring them to the appropriate cleat prior to mooring or docking operations. As with mooring lines that remain on deck, removal of the mooring lines and replacement prior to docking adds time to the docking procedure because the line must be located, carried to the appropriate location, and attached to the desired cleat. This process increases the risk that a mooring line will be improperly affixed to a cleat during the mooring operations.

The time lost during reattachment of mooring lines and the repositioning of poorly attached mooring lines can be critical if a skipper needs a fast securement to the dock in the event of an untoward docking situation, such as when other boats may limit free navigation or high seas or winds make docking particularly tricky.

Many boats are configured so that the stem mooring lines are easily accessible by the passengers, as they are located at the ingress/egress area of the watercraft. However, the bow mooring lines are remotely located, and frequently require someone to walk the deck to the front of the watercraft to manipulate the mooring line or lines that may be tangled or fouled or may be wet and slippery due to exposure to the elements. Walking the deck to the front of the watercraft can be treacherous in heavier weather and can be stressful to neophyte sailors in any weather condition. The danger and stress are compounded when the mooring line(s) are disorganized or not readily associated with the appropriate cleat. Such conditions can cause delays in deploying the bow mooring line(s) that may translate into accidents and collisions between the watercraft and dock during mooring operations, which can involve some danger, and may also involve delay in deploying the bow mooring line or lines.

There is also a need for compact, easily accessible storage devices in various other recreational and transportation applications including but not limited to motorcycles and the like.

Accordingly, what is needed in the art is some effective, simple and easy device and system for storing and organizing mooring lines that provides ready access when docking is imminent. It is also desirable to provide a suitably anchorable storage device for other transportation applications.

SUMMARY

Disclosed herein is a mooring line storage device and system for watercraft. The storage device and system includes a housing defining an inner cavity. The housing has at least one access aperture located therein and a cover in overlying relationship to the aperture. The cover and associated housing cooperatively interact to prevent extension of a discrete region of a mooring line from the inner cavity outward therefrom. The mooring line storage device also includes at least one hanger member connected to the housing and adapted to engage at least one structural member of the watercraft. It is contemplated that at least one mooring line storage device can be used with an associated watercraft to form a mooring line storage system.

Also disclosed is a releasable storage system for various transport applications including a rigid housing defining an inner cavity with at least one closable aperture defined therein. The releasable storage system also includes at least one hanger member connected to the housing adapted to be releasably connected to the associated transport vehicle.

BRIEF DESCRIPTION OF THE DRAWINGS

The description makes reference to the accompanying drawings wherein the reference numbers refer to like parts throughout the several views, and wherein.

DESCRIPTION

Disclosed herein is a mooring line storage device for a watercraft. The mooring line storage device can be removably mounted on a structural member of the watercraft and can be suitably located adjacent to the boat deck in a manner that provides safe and convenient storage for a mooring line or lines. At least one mooring line storage device can be used with an associated watercraft to form a mooring line storage system.

As used herein, the term "watercraft" is taken to mean various passenger vessels used upon various waterways including, but not limited to, lakes, rivers, and oceans. The watercraft may be powered by any means such as sail or motor and may be of suitable size to accommodate at least one individual. Suitable examples of watercraft include sailing vessels and motorized vessels configured to hold an individual or individuals. Watercraft suitable for use with the device disclosed herein will have mooring cleats or other docking attachment mechanisms associated with the decking or gunwales of the watercraft and will preferably include a rail or other structural member located in proximity to the cleat or other docking attachment mechanism. The cleat or attachment mechanism of choice is one configured to receive and anchor a suitable mooring line or lines.

Figure 1:
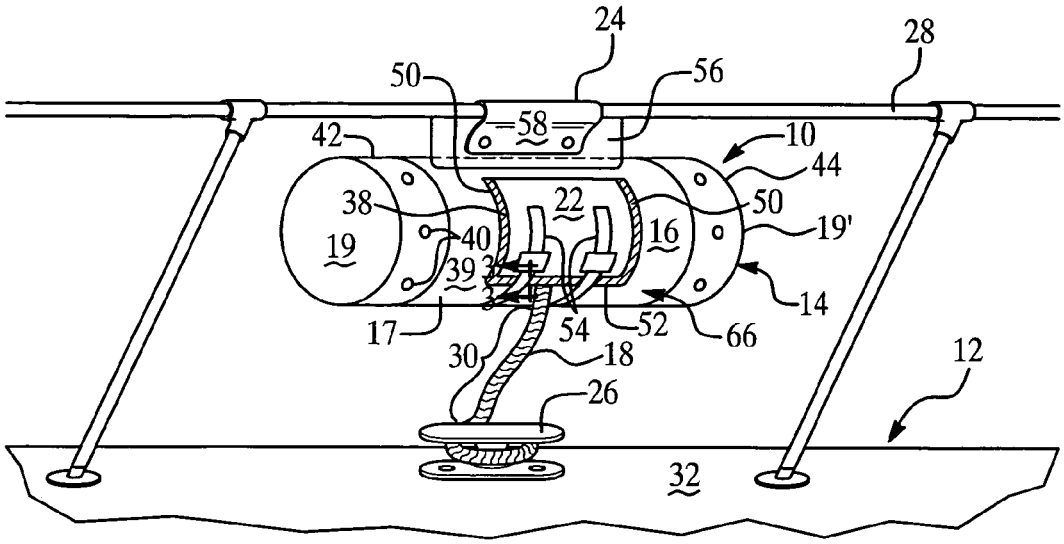
FIG. 1 is a perspective view of the mooring line storage device mounted on a suitable boat or watercraft.

Referring to FIG. 1, a mooring line storage device 10 is depicted in use with an associated watercraft 12. The mooring line storage device 10 includes a housing 14 having a body 16 that defines an inner cavity. The inner cavity is adapted to releasably contain at least a portion of a mooring line such as mooring line 18. The body 16 also includes at least one access aperture 20 defined therein to permit insertion and removal of the mooring line 18. The mooring line storage device 10 also includes a flap 22 overlying the access aperture 20 movable between an open and a closed position relative thereto.

The mooring line storage device 10 can be connected to a suitable structural member of the associated watercraft 12 by a hanger member 24 or other suitable device. The hanger member 24 is configured to removably engage a suitable structural member of the watercraft proximate to cleat 26. As depicted, hanger member 24 engages railing 28 in a slidably or translationally oriented manner such that the mooring line storage device 10 can be suspended in close proximity to cleat 26. The first end of mooring line 18 can be configured in any manner for facilitating releasable attachment with a suitable docking facility.

Figure 2:
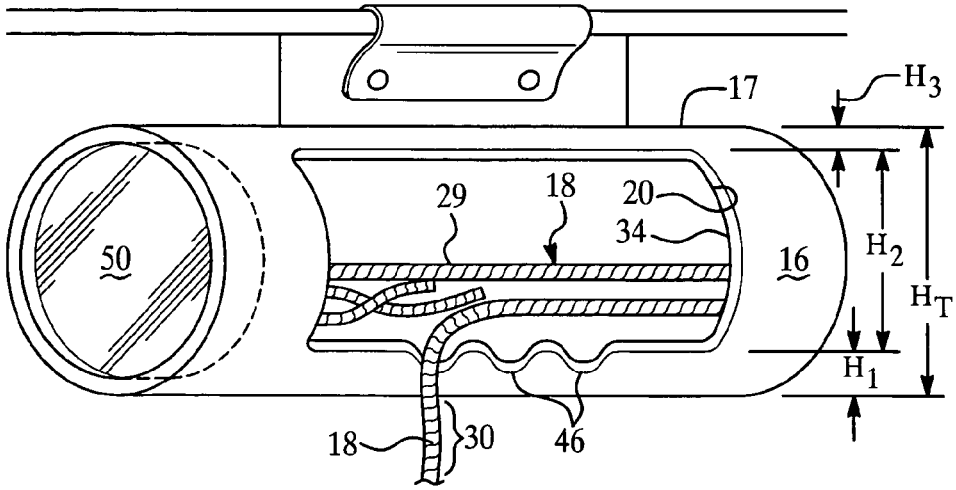
FIG. 2 is a perspective view of FIG. 1 with cover and side panel removed.

As more particularly depicted in FIG. 2, the mooring line storage device 10 as disclosed herein can further include at least one mooring line 18 removably contained in the inner cavity defined in the housing 14. The mooring line 18 has a first end region (not shown) and an intermediate region 29 adapted to be contained within the inner cavity of the housing 14. The mooring line 18 has an opposed second end region 30 that, as depicted, extends outward from the housing 14. The first end of mooring line 18 can be configured in any manner suitable for facilitating releasable attachment with a suitable docking facility. The second end region 30 can be configured with a suitable loop so as to be appropriately attached to at least one fastening member located on the deck surface of watercraft 12 such as cleat 26. Thus, in one operative arrangement, the second end region 30 of the mooring line 18 extends outward from the housing 14 into engagement with at least one cleat 26 affixed to the deck of watercraft 12. In this operative configuration, it is contemplated that the second end region 30 will have a length sufficient to maintain the mooring line storage device 10 in sufficiently taut orientation relative to the handrail 28 and underlying deck surface 32.

While only one mooring line storage device 10 and associated mooring line and cleat is depicted herein, it is contemplated that a watercraft 12 may be equipped with multiple mooring line storage devices 10 proximate to various mooring lines 18 and associated cleats 26 to provide storage for various lines located on port and starboard. While the mooring line storage device 10 can be advantageously employed with bowlines, it is also contemplated that the mooring line storage device 10 can be used with stem lines as desired and required. Thus, where desired or required, it is contemplated that a separate mooring line storage device 10 can be employed for each side of the bow and/or stem to store the respective mooring lines proximate to their respective watercraft cleats or fastening devices.

Where multiple mooring line storage devices 10 are employed on a watercraft 12, it is contemplated that the multiple devices can be cooperatively used as a mooring line storage device system. Where used as such, it is contemplated that the housings of the respective mooring line storage devices can be configured with suitable indicia to assist in identifying the desired mooring line or lines contained therein.

It is also contemplated that storage device 10 can be employed to receive and store one or more marine lines such as would be used with various sails and the like. As with mooring line storage, the suitable storage device(s) can be configured with suitable indicia to assist in identifying the associated marine line.

The housing 14 can have any suitable configuration. It is contemplated that the housing 14 will be configured in a manner suitable for placement and use on the watercraft 12. The configuration will be one that is aesthetically pleasing and, where appropriate, provide aerodynamic characteristics. As depicted in the drawing figures, the housing 14 is an extended cylindrical shape. However, other configurations can be suitably substituted.

As depicted in FIG. 1, the body 16 of housing 14 is composed of a cylindrical central cylindrical portion 17 and two opposed end portions 19, 19' contiguously attached thereto. Attachment between central cylindrical portion 17 and the respective end portion 19 or 19' can be by any suitable means including, but not limited to, seam welding, and the like. It is contemplated that the attachment between central cylindrical portion 17 and end members 19, 19' can be one that provides suitably water-resistant engagement between the respective members where desired or required. Cylindrical portion 17 can be composed of one or multiple elements constructed into a suitable cylinder.

Figure 3:
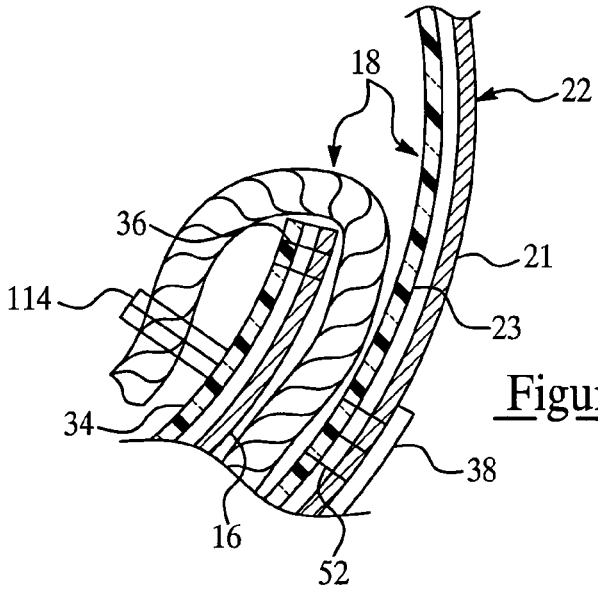
FIG. 3 is a detail cross section taken along the 3—3 line in FIG. 1.

The body 16 of mooring line storage device 10 may be composed of one or multiple layers. As depicted in FIGS. 3 and 4, the body 16 is composed of an outer layer 21 and inner layer 23. The outer layer 21 of body 16 can be constructed from any suitable material. It is contemplated that the material of choice will be a durable, weather-resistant material. The desired material can exhibit at least some water resistance or repellence, either inherently or imparted by suitable treatment. The material of choice may be a suitable woven material such as canvas or the like. The canvas material of choice can exhibit appropriate water resistance or repellency, heat or temperature resilience, and can be treated to possess ultraviolet light resistance and mildew resistance as appropriate for marine applications.

It is contemplated that the outer layer 21 can be positioned in overlying relationship with at least one inner layer 23. The inner layer 23 can be composed of any appropriate material. Materials of choice include those that provide a degree of structural rigidity to the housing 14. Suitable materials typically will be light-weight and exhibit appropriate resistance to wear and external environmental factors such as temperature, sunlight, water, and the like. Materials for the inner layer 23 include, but are not limited to, various forms of rigid plastic. It is contemplated that a flexible, cloth-like outer layer 21 will overlay a more rigid inner layer 23 as depicted in FIG. 3. It is contemplated that the rigid layer 23 can define a unitary rigid canister having a suitable shape such as a cylinder or the like configured with a suitable access aperture 20. The canister can be made of any suitably rigid and durable material such as molded plastic and the like with a suitable canvas or other covering layer in overlying relationship thereto. The overlying layer will typically be composed of a material that contributes to at least one of frictional contact ability, insulative characteristics, and the like as desired or required.

The mooring line storage device 10 will include appropriate layer connecting mechanisms to insure the appropriate contact between the respective outer layer 21 and inner layer 23. As depicted in FIG. 3, such layer connecting mechanisms include but are not limited to stitching, as at reference numeral 36, reinforcement webbing and stitching assemblies as at 38, and grommets as at reference material 40. Other attachment mechanisms for securing the various layers may be used as desired or required.

It is also contemplated that the mooring line storage device 10 can be constructed as a unitary walled member. In situations where rigidity is not required, the housing of the mooring line storage device 10 can be composed of a woven or fabric material such as canvas. In situations where rigidity is desired, it is contemplated that the mooring line storage device 10 can be constructed of a material having greater structural rigidity such as various plastics. It is contemplated that the dual-wall construction discussed previously can be implemented throughout the device 10. Alternately, it is contemplated that dual-wall reinforcement can be present at critical locations on the mooring line storage device 10. Where localized reinforcement is desired or required, it is contemplated that dual-wall reinforcement will be located proximate to the aperture 20 and associated cover 22. Reinforcement may also be present along the first and second edges 42, 44 of the cylindrical portion 17 of housing 14, to help maintain structural shape of the housing.

The inner cavity of the housing 14 can be accessed by a suitable aperture 20 defined in the body 16. The aperture 20 is configured to provide suitable access to the inner cavity in a manner that permits the deposit and removal of a mooring line or lines such as mooring line 18 from residence in the inner cavity. The aperture 20 is positioned in the cylindrical body 16 such that the height or distance (H1) between the base of the cylinder and the lower opening of the aperture 20 is between 10% and 50% of the total height (Ht) of the cylindrical body. The aperture 20 is configured such that the height of the aperture (H2) relative to total height (Ht) is between 10% and 50% with the balance or distance between the upper portion above the aperture (H3) being between 10% and 58% of the total height (Ht).

Figure 4A:
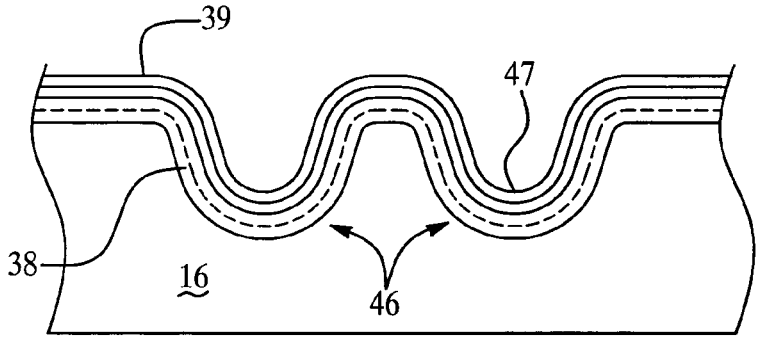
FIG. 4A is a detail view of the detent region of the aperture section of the device of FIG. 1.

It is contemplated that the aperture 20 will have at least one suitable line mooring line-retaining region 46 defined therein. As depicted in FIG. 2 and in detail in FIGS. 4A and 4B, the mooring line retaining region(s) 46 can be suitably configured with detent(s) 47 defined in the lower edge of the aperture 20 as defined when the mooring line storage device 10 is oriented in the operative position. The detent(s) 47 will have an appropriate configuration to releasably contain and orient the mooring line 18 relative thereto. As depicted in FIG. 4A, the detent(s) 47 are curved depressions formed in the respective outer layer 21 and inner layer 23 proximate to aperture 20 and configured to receive or surround at least a portion of the cross-sectional diameter mooring line 18. As depicted in FIG. 4A, the detent(s) 47 have a semicircular configuration. However, the detent 47 may have any configuration that will hold the mooring line 18 relative thereto.

As depicted in FIG. 4A, the mooring line retaining region 46 includes suitably configured regions of outer layer 21 and inner layer 23. The mooring line retaining region 46 may also include an appropriate reinforcement region 38 as desired or required. One non-limiting example of a suitable reinforcement region 38 is a webbing element as depicted in FIG. 4A. Inner layer 23 and outer layer 21 can be joined at reinforcement region 38 and are configured to frictionally engage the surface of the mooring line 18 that comes into contact therewith. Such frictional engagement serves to minimize or prevent further play out of the mooring line 18 from the inner cavity when and if the mooring line 18 is subjected to tension at levels as would be encountered during pivotal movement of the housing 14 relative to the associated structural mounting member as when the watercraft 12 is underway.

Figure 4B:
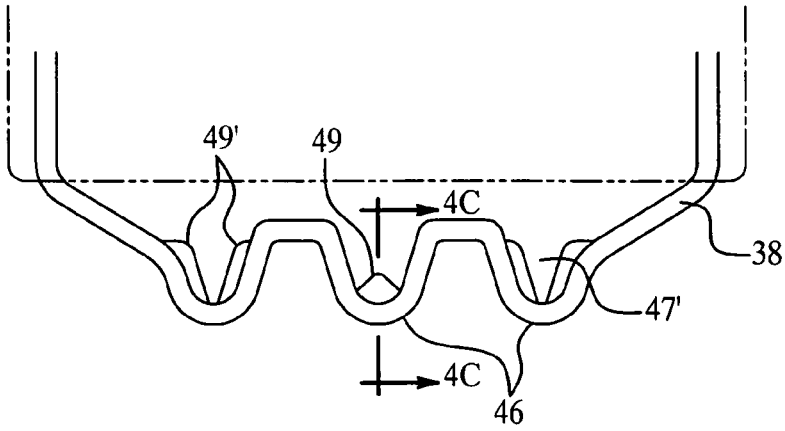
FIG. 4B is a detail view of an alternate embodiment of the detent region of the aperture sectional device of FIG. 1.
Figure 4C:
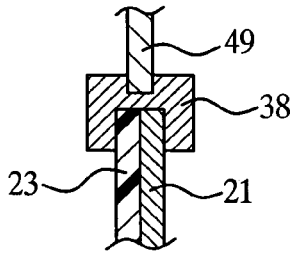
FIG. 4C is a cross sectional view of the detent region as depicted in FIG. 4C.

To further enhance mooring line retention, the mooring line retaining region 46 can include a suitable reinforced region 38 as depicted in FIG. 4B, in which the region 38 is defined by a suitable retentive material such as thermoplastic rubber and the like, of which SANTOPRENE is one non-limiting example. As depicted in FIGS. 4B and 4C, mooring line retention can be further enhanced by mooring line engaging grips 49 connected to and projecting outward from reinforcement region 38. The engaging grips 49 can be configured in any manner suitable to releasably engage the surface of the mooring line to limit lateral movement of the line relative to the grip. As depicted, the grip 49 can be configured as a single projection adapted to flexibly engage the mooring line surface. Grip(s) 49 can also be positioned to deflectably contain mooring line therebetween.

In the mooring line storage device 10 as depicted herein, the aperture 20 is covered, at least in part, by a suitable cover 22. The cover 22 can be configured in a manner that maintains the mooring line 18 in the inner cavity until desired or required. As depicted, the cover 22 is a flap element such as flap 22. Other suitable cover configurations can be employed in the device as depicted herein. These include, but are not limited to slides, duffle closures, and the like. The cover 22 may be configured to completely overlay the aperture 20 in a manner that minimizes or eliminates the entry of water, debris, and the like into the inner cavity where desired or required. Additionally, it is contemplated that the cover 22 can be configured and utilized to maintain the mooring line 18 in functional engagement with a suitable detent(s) 47.

Figure 5:
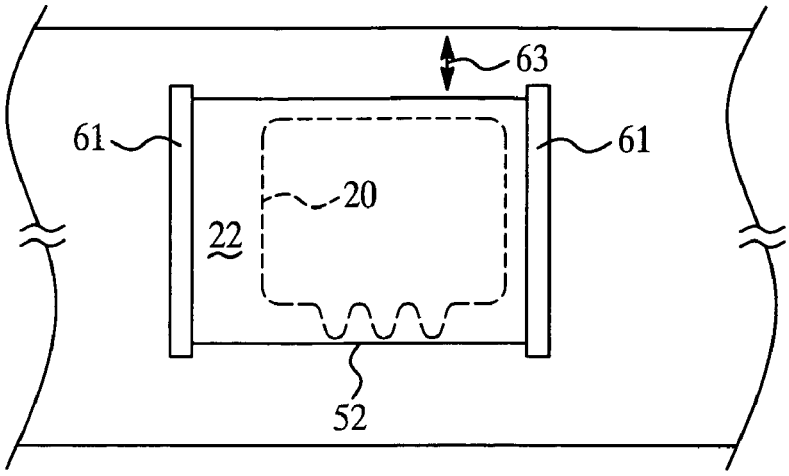
FIG. 5 is a detail view of an alternate cover embodiment.

Turning now particularly to FIGS. 1 and 3, cover 22 is configured as a flap element. It can be seen that the flap element can be attached to the housing 14 in a pivotal or moveable manner as at attachment point 48. Such attachment can be by sewing, or other suitable attachment devices. The flap element may be constructed from suitable material. As with the body 16, the flap element may be of unitary or multi-layer construction.

Where desired or required, the flap element may have suitable webbing reinforcement 39 along the outer peripheral side edges 50 and lower edge 52. As can be seen in FIGS. 3 and 5, it is contemplated that the lower edge 52 of the flap element is adapted to extend and fully cover detents 47 when flap 22 is in the lowered or closed position. It is further contemplated that when flap element is in the lowered or closed position, a suitable fastening mechanism such as buckle 54 can be engaged to securely position the flap element in overlying relationship to the associated portion of the body 16 with a portion of the lower end region 30 of mooring line 18 securely positioned therebetween.

As discussed previously, it is contemplated that the mooring line storage device 10 can be configured with one or more detents 47 to position the mooring line 18 in appropriate extended relationship when the mooring line storage device is in the operative position. The interior surface of flap element is configured to engagingly contact the exteriorly extending portion 30 of mooring line 18 in a manner that urges a portion of the mooring line 18 into contact with the associated detent 47 and the region of the body 16 proximate thereto. The device 10 can be equipped with one or more fastening members 54 to securely position the flap element in the closed position and maintain the mooring line 18 appropriately.

Figure 8:
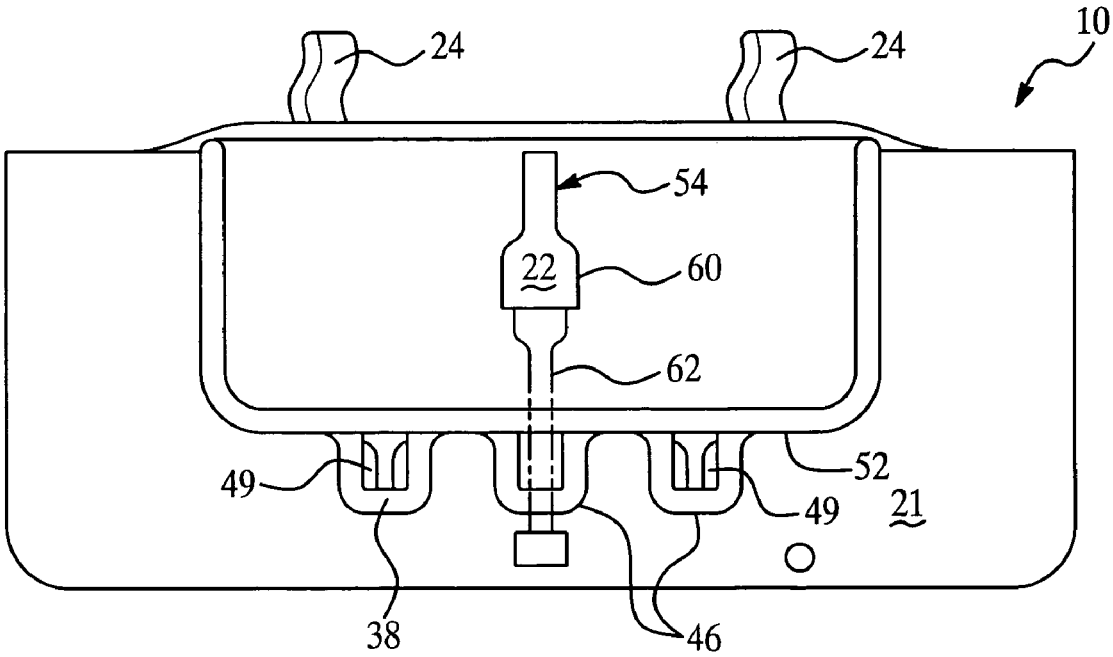
FIG. 8 is a front view of an alternate embodiment of the device disclosed herein.

Alternately, the flap 22 can be configured such that the lower edge 52 defines an upper mooring line engaging surface cooperative with detents 46 as in FIG. 8. It is contemplated that cooperative action of flap 22, detent 46, and mooring line 18 can function to effectively close openings defined by detent 46 in order to prevent or minimize entrance of debris or the like. The detent(s) grips 49 as desired or required.

Device 10 can include one or more suitable fasteners 54 adapted to secure flap 22 in position overlying the aperture in body 14. As depicted in FIG. 1, multiple fasteners 54 each include a flap mounted element and a mating body mounted element positioned to facilitate projection of mooring line therebetween. In FIG. 8 a single fastener 54 includes a flap mounted element 60 adapted to releasably mate with a body mounted element 62 (shown in partial phantom). The single fastener overlies detent 46 when in the fastened position and is configured to engage the mooring line extending therethrough. It is contemplated that fastener(s) 24 can have suitable adjustment means to alter the tension on flap member 22 and accommodate mooring line 18 in a secure manner.

An alternate cover member configuration is depicted in FIG. 5. In this alternate configuration, cover 22 is a flexible panel member 58 slidably positionable over aperture 20 by means of slide members 61 positioned in parallel opposed relationship with aperture 20 disposed therebetween. The panel 58 is slidable in the directions indicated by arrow 63. The panel member 58 can be configured to engage mooring line 18 in the manner discussed previously. It is contemplated that the panel member 58 can be secured in the closed position by any suitable fastener arrangement or configuration.

Figure 6A:
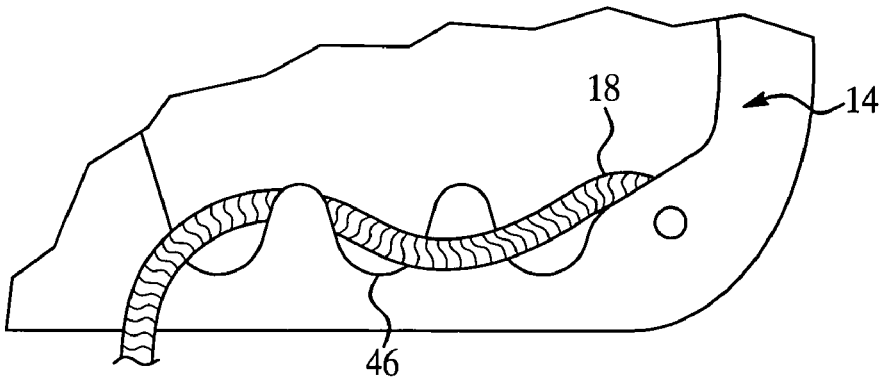
FIG. 6A is an alternate version of orientation of mooring line and detent.

The mooring line 18 can be threadingly arranged through one or more of the detents 47 to provide engagement between the aperture surface and the mooring line. Thus it is contemplated that the mooring line 18 may be threaded through one detent 47 as in FIG. 2. Alternately, the mooring line 18 can be threaded through multiple detents 47 as illustrated in FIG. 6. It is contemplated that the action of cover 22 when fastened to the body 14 can function to anchor the threaded mooring line 18 securely in relation to the aperture 22 and the associated body 14.

The inner cavity of the mooring line storage device 10 may also be a suitable ring snap member 114 mounted to the interior surface of body 16 and adapted to releasably engage mooring line 18 such that mooring line 18 is securely fastened to the inner wall of the inner cavity. As depicted in FIG. 3, the mooring line 18 is urged into U-shaped orientation relative to the detent 47. Thus the ring snap member maintains the mooring line 18 in engagement with the detent. The ring snap member 114 can also serve to further limit play out of the mooring line 18 due to frictional engagement between member 114 and the mooring line 18.

Figure 6B:
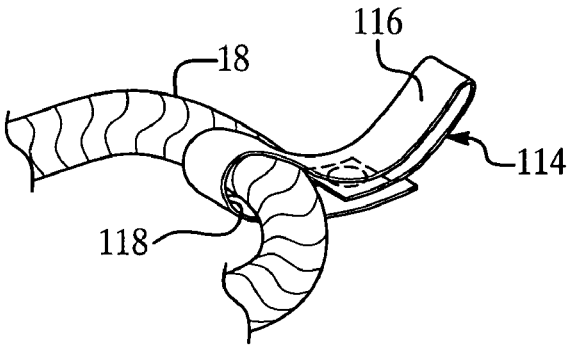
FIG. 6B is a detail view of a strap holder in the mooring line storage device.

The snap ring fastener 114 may have any configuration suitable for maintaining the mooring line in position relative to the body of the mooring line storage device 10. One non-limiting example of a suitable configuration is depicted in FIG. 6B. The snap ring fastener 114 as depicted therein is an elongated ribbon 116 affixed to the interior of the body proximate to the lower region of one end of the aperture 22. As depicted, the ribbon 116 includes a suitable releasable snap fastener having mating members positioned in the ribbon to define a suitable eyelet 118 through which the mooring line 18 can be maintained. The mooring line 18 can be threaded through the eyelet such that the respective ends of the mooring line double back on one another to further maintain the mooring line in position in the interior cavity.

The mooring line storage device 10 also includes at least one hanger member 24 connected to the body 16 and adapted to engage at least one structural member of the watercraft 12. In the device disclosed herein, the hanger member 24 engages a suitable railing 28 proximate to the cleat 26. In this manner, the mooring line storage device 10 can be suspended above the cleat 26 in a proximate location thereto. As depicted, a single elongated hanger member 24 is attached to an upper region of the body 16 in a suitable manner as by stitching or the like. As depicted, the hanger member 24 includes support panel member 56 extending from the body 16. An upper member 58 extends contiguously from a distal end of the panel member 56. At least one attachment device is connected to upper member 58 and releasably engageable with a mating attachment device located on the panel member 56 to form a loop or open conduit adapted to surround the selected structural member of watercraft 12 such as guardrail 28.

Figure 9:
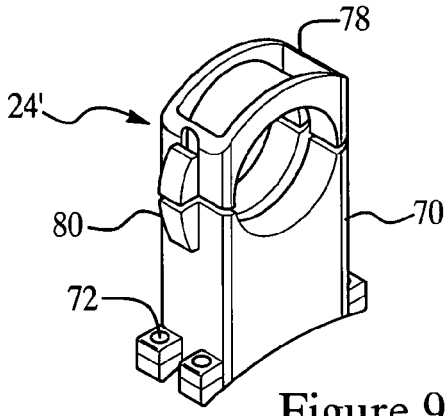
FIG. 9 is a perspective view of an alternate embodiment of an attachment device suitable for use with the device disclosed herein.

Other appropriate hanging mechanisms can be employed to suspend the mooring line storage device 10 as desired or required. The device 10 may include multiple hanger members 24 as depicted in FIG. 8. The hanger member(s) may be configured to grippingly engage a suitable structural element of the associate boat such as guardrail 28. The hanger(s) 24 can be adjustable to engage guard rails of different cross section, size, etc.

Where desired or required, it is also contemplated that hanger member(s) 4 can be configured to be mounted to the structural member with suitable means for permanently or releasably engaging the device 10. One non-limiting example of such hanger member is depicted in FIG. 9 at reference numeral 24'. Hanger member 24' includes a base 70 adapted to be mounted to the surface 21 of storage device 10 by suitable means such as screws threaded through bolt holes 72. The opposed face 74 of base 76 can be configured to engagingly receive the surface of rail 28 therein.

Hanger member 24' also includes a mating clamp 78 adjustably mounted relative to base 70 as by screws or the like. As depicted in FIG. 9, screws can be threadingly received in opposed outwardly projection flanges 80. In this manner, the mechanism can be adjusted to accommodate rails of varying size and contour in a manner that provides secure positioning relative to rail 28.

The inner cavity of the mooring line storage device 10 can be configured to suitably receive the mooring line 18 therein. As depicted, the inner cavity is essentially cylindrical with the access aperture 20 positioned such that a lower mooring line storage area is formed. The cavity may have suitable optional mooring line organizing devices as desired or required.

The inner cavity of the mooring line storage device 10 can also be a suitable ring snap member 114 mounted to the interior surface of body 16 and adapted to releasably engage mooring line 18 such that mooring line 18 is securely fastened to the inner wall of the inner cavity. As depicted in FIG. 3, the mooring line 18 is urged into U-shaped orientation relative to the detent 47. Thus, the ring snap member maintains the mooring line 18 in engagement with the detent. The ring snap member 114 can also serve to further limit play out of the mooring line 18 due to frictional engagement between member 114 and the mooring line 18.

Figure 7:
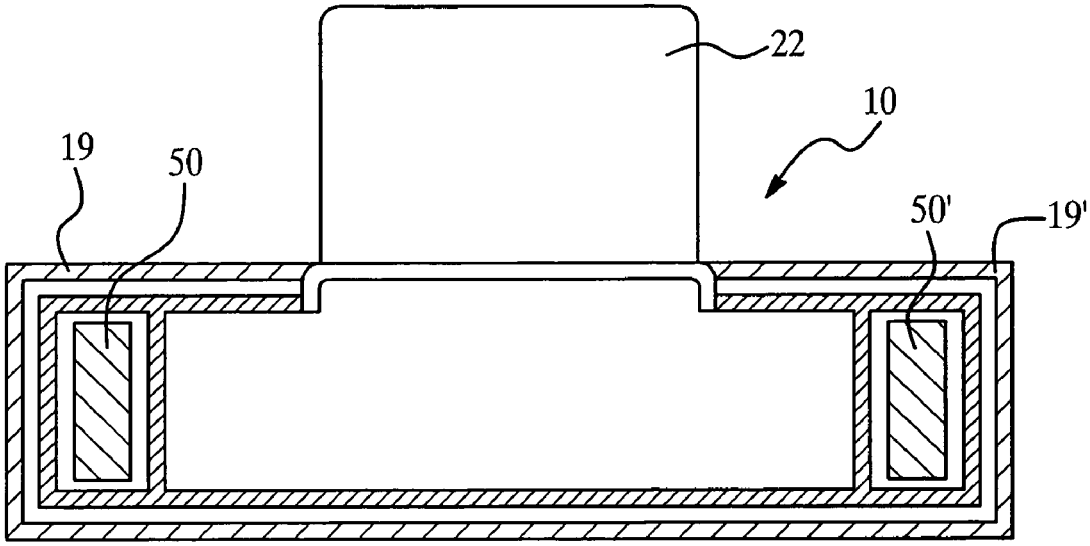
FIG. 7 is a cross-sectional representation of an embodiment of a mooring line storage device with self-contained buoyancy elements.

It is also contemplated that the interior cavity can be configured to contain appropriate buoyancy aids and the like. Non-limiting example of a suitable buoyancy aid are cylindrical buoyancy inserts 50 such as those depicted in FIGS. 2 and 7. As depicted in FIGS. 2 and 7, it is contemplated the inner cavity can include appropriate inner walls formed of a suitable foamed polymeric material or other positive buoyancy materials. The level of buoyancy imparted by the buoyancy aids may be that necessary to maintain the mooring line storage device 10 with mooring line 18 located therein afloat in the water for an interval sufficient to retrieve it. Thus the mooring line storage device 10 can be configured to exhibit at least a small degree of positive buoyancy such that the device would float if inadvertently introduced into the water or dropped overboard.

Where desired or required, the buoyancy inserts 50 can be configured to provide greater degrees of positive buoyancy. The greater amounts of positive buoyancy can be an amount sufficient to permit the device to function as a rescue aid in man over board procedures. While it is contemplated that in certain situations the device 10 can be configured to function as a floatation device, it is also contemplated that the device 10 could function as a marker member during such drills. As such, the device 10 can be configured and colored to make identification in the water more apparent.

As desired or required, the device 10 may have suitable vent or drainage holes 66 to facilitate removal of introduced fluid, water vapor, or the like.

The mooring line storage device 10 may also include suitable means for retracting and/or projecting the mooring line 18 relative to the storage device 10. The retracting means can be any suitable manual and/or automated or mechanical reel, spool, or other gathering or winding mechanism. The retracting and/or projecting means can feed some or all of the mooring line as desired or required.

As indicated previously, it is contemplated that the mooring line storage device can be employed to store or organize various lines such as those associated with sails and the like.

Figure 10A:
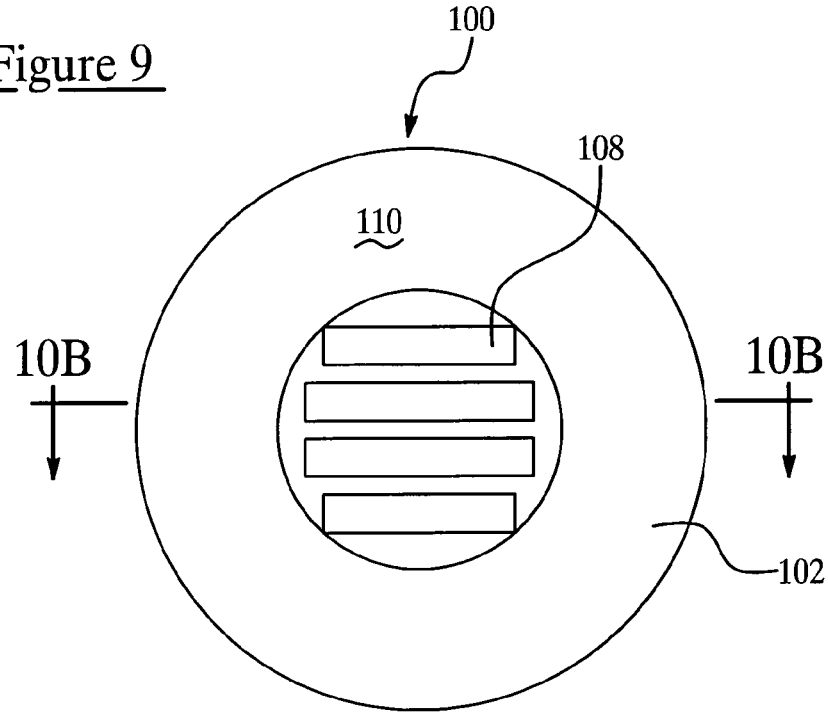
FIG. 10A is a top view of a vent suitable for use in the storage device as disclosed.
Figure 10B:
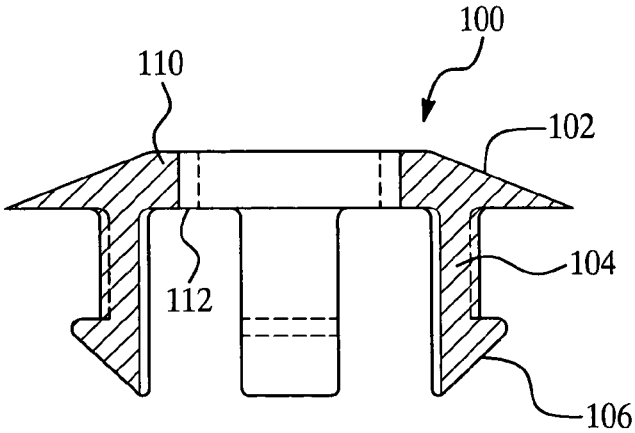
FIG. 10B is a cross-section through the 10—10 line of FIG. 10A.

The mooring line storage device can also include suitable ventilation elements associated with the housing in order to regulate temperature, humidity, and the like in the interior cavity. One suitable vent is depicted in FIGS. 10A and 10B. The vent 100 is composed of a flange head 102 having at least one housing engaging retention member.

In use, it is contemplated that a mooring line storage device 10 as disclosed herein can be attached to the watercraft 12 at a suitable structural member such as handrail 28 proximate to cleat 26. When moored, the watercraft 12 is maintained in contact with a suitable slip or other mooring facility by at least one mooring line such as mooring line 18. One end of mooring line 18 is attached to cleat 26 while an opposed end is secured to a suitable dockside cleat or other attachment mechanism. The mooring line storage device 10 can be maintained empty in engagement with the handrail 28. Alternately, the device 10 can be removed and stowed in an appropriate storage compartment.

When the watercraft is to be removed from its mooring, the device 10 can be positioned proximate to the cleat 26 (if not already so positioned). The dockside end of mooring line 18 can be detached from dockside attachment and hauled in to the associated watercraft. The mooring line 18 can be coiled and positioned in the inner cavity of the housing 14. The outer end region 30 of the mooring line 18 remains external to the mooring line storage device 10 with the terminal end remaining attached to the cleat 26 with the mooring line engaging one of the detents 47. Snap ring member can be fastened to inner wall of the inner cavity and help maintain it relative to detent 47. The cover 22 can be fastened thereby maintaining the mooring line 18 in essentially fixed relation to the mooring line storage device 10.

The mooring line storage device 10 can remain in fixed relationship with the structural member of watercraft 12 such as handrail 28 while the vessel is underway. When mooring is desired, an individual can open the cover 22 and access the mooring line 18 by reaching into the interior cavity through aperture 22. The snap ring member 114 can be disengaged from contact with the mooring line 18. The mooring line 18 can be affixed to the appropriate dockside cleat or other attachment device to insure that the watercraft 12 is in appropriate moored positioned. As desired or required, the empty mooring line storage device 10 can remain suspended to the handrail 28 or can be removed and stored until needed.

In this manner, the mooring line 18 is safely stowed during any sailing or other boating activities and is readily accessible during docking maneuvers. If the mooring line 18 is not required for the particular docking maneuver, it is also contemplated that the end of the mooring line 18 can be removed from the cleat and the mooring line transported in the mooring line storage device to a more permanent storage facility.

When a mooring line storage system is desired, one or more mooring line storage devices 10 can be employed and associated, each with a respective cleat, where desired. The individual devices can be coded with appropriate indicia to enable an inexperienced sailor or boater to correctly identify the desired device and associated mooring line upon instructions from the skipper or pilot of the watercraft.

When in use, it is contemplated that the cover 20 and aperture 22 of each respective mooring line storage device faces toward the interior of the watercraft to facilitate easy access.

While preferred embodiments, forms and arrangements of parts of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A mooring line storage device for a watercraft, the storage device comprising:

a housing, the housing having a body defining an inner cavity, the cavity adapted to removably contain at least a portion of a mooring line, the mooring line having one end extending from the inner cavity into releasable engagement with at least one cleat located on a watercraft, the body having at least one access aperture located therein;

a cover overlying the access aperture, the cover including a flap movable between an open position and a closed position, a mooring line engaging region connected to the flap and at least one fastener, the fastener releasably engageable with the outer body of the housing, wherein the access aperture includes at least one detent defined therein, the detent configured to releasably engage a portion of the mooring line;

at least one hanger member connected to the body, the hanger member configured to engage at least one structural member of the watercraft.

2. The mooring line storage device of claim 1 further comprising at least one engagement grip projecting outward from the detent into releasable engagement with the mooring line.

3. A storage device comprising:

a housing, the housing having a body defining an inner cavity, the cavity adapted to releasably contain at least a portion of a mooring line, the body having at least one access aperture located therein, wherein the access aperture is configured with at least one detent adapted to releasably engage a mooring line, the housing including an outer layer and an inner layer;

a cover overlying the access aperture;

at least one hanger member connected to the body.

4. The storage device of claim 3 wherein the cover is movable between an open and a closed position and wherein the cover and access aperture are configured in a manner that maintains the mooring line in fixed relation with the housing and cover when the cover is in a closed position.

5. The storage device of claim 3 wherein the hanger comprises a base attached to the housing and projecting outward therefrom and at least one clasp adjustably connected to the base, the projection and the clasp defining a second aperture configured to contain a structural member of a watercraft therein.

6. The storage device of claim 5 wherein the structural member of the watercraft is a deck rail.

7. The storage device of claim 3 wherein the housing further comprises at least one buoyancy insert, the buoyancy insert positioned in auxiliary compartments defined in the housing.

8. The storage device of claim 3 further comprising at least one vent member positioned on the housing.

9. The storage device of claim 3 further comprising a mooring line retraction device located in the inner cavity of the housing.

10. The storage device of claim 9 wherein the mooring line retraction device is a snap ring fastener affixed to an inner surface of the inner cavity and releasably engaging the mooring line positioned therein.

11. The storage device of claim 3 wherein the access aperture is contented with a plurality of detents positioned on a lower edge of the aperture, the detents configured to releasably engage an elongated portion of the mooring line.

12. The storage device of claim 3 wherein the cover is attached to the body and is movable between an open position and a closed position, the cover comprising a mooring line engaging member and at least one fastener, the fastener releasably engageable with an outer body of the housing.

13. The storage device of claim 9 wherein the access aperture is configured with a plurality of detents positioned on a lower edge of the aperture, the detents configured to releasably engage an elongated portion of the mooring line.

14. A mooring line storage system for a watercraft, the system comprising a plurality of mooring line storage devices removably positioned on structural members of the watercraft proximate to mooring line anchoring devices, the mooring line storage devices each comprising:

a housing, the housing having a body defining an inner cavity, the cavity adapted to releasably contain at least a portion of a mooring line, the body having at least one access aperture located therein and at least one detent defined in the aperture;

a cover overlying the access aperture, the cover including a flap movable between an open position and a closed position, a mooring line engaging region connected to the flap and at least one fastener, the fastener releasably engageable with the outer body of the housing;

at least one hanger member connected to the body, the hanger member adapted to engage the structural member of the watercraft; and at least one mooring line removably contained in the inner cavity, the mooring line having one end extending outward therefrom into engagement with that associated mooring line attachment device located on the watercraft.

15. The storage device of claim 3 wherein the at least one detent further comprises a reinforced region and at least one engaging grip connected to and projecting outward from the reinforced region to releasably engage the mooring line.

16. The storage device of claim 3 wherein the mooring line is removably contained in the inner cavity, the mooring line having one end extending outward therefrom into engagement with at least one cleat located on a watercraft.

* * * * *